US007617551B1

(12) United States Patent
Deluzio

(10) Patent No.: US 7,617,551 B1
(45) Date of Patent: Nov. 17, 2009

(54) BABY CHANGING PAD COVER

(76) Inventor: Jennifer Deluzio, 1208 Colts La., Yardley, PA (US) 19067

( * ) Notice: Subject to any disclaimer, the term of this patent is extended or adjusted under 35 U.S.C. 154(b) by 0 days.

(21) Appl. No.: 12/173,395

(22) Filed: Jul. 15, 2008

(51) Int. Cl.
*A47C 20/02* (2006.01)

(52) U.S. Cl. ..... 5/499; 5/655

(58) Field of Classification Search ..... 5/655, 5/487, 496–500, 484
See application file for complete search history.

(56) References Cited

U.S. PATENT DOCUMENTS 5,305,483 A 4/1994 Watkins
7,487,560 B2 * 2/2009 McGrath et al. ..... 5/488

FOREIGN PATENT DOCUMENTS

GB 2 308 297 A 6/1997
GB 2 413 758 A 11/2005
WO WO 01/49151 A1 7/2001

* cited by examiner

*Primary Examiner*—Fredrick Conley
(74) *Attorney, Agent, or Firm*—RatnerPrestia

(57) ABSTRACT

A baby changing pad cover positionable over a changing pad includes a first portion configured to receive the lower portion of a baby, a second portion configured to receive the upper portion of a baby, and fasteners for detachably fastening the first portion and second portion together. The first portion includes a substantially non-absorbent surface and the second portion includes a substantially absorbent surface which is preferably soft-textured. The substantially non-absorbent surface is highly impervious to diaper messes, thus enabling a user to wipe off a mess and save the time and resources required to replace, change, or wash the cover after each use. The substantially absorbent surface preferably has a soft texture so that a baby is comfortable with its upper portion resting on the soft surface.

13 Claims, 1 Drawing Sheet

BABY CHANGING PAD COVER

FIELD OF THE INVENTION

The present invention pertains to baby changing pads and particularly to covers for baby changing pads.

BACKGROUND OF THE INVENTION

Parents and caretakers are often faced with the task of changing a baby's diaper numerous times per day. One of the most time-consuming burdens associated with diaper-changing is cleaning up the diaper messes that frequently occur while the baby is being changed. In order to contain such messes and prevent them from soiling clean surfaces, a baby is often placed on a changing pad so that the diaper messes are contained on the surface of the changing pad or the changing pad cover. The cover of a pad is generally made of an absorbent material that can become soiled and, consequently, must often be washed or changed before a subsequent use. Therefore, parents and caretakers must continually spend a great deal of time and effort cleaning diaper messes off of soiled changing pad covers.

SUMMARY OF THE INVENTION

The present invention provides a baby changing pad cover that is positionable over a changing pad. The changing pad cover comprises a first portion, which is configured to receive the lower portion of a baby; a second portion, which is configured to receive the upper portion of a baby; and means for detachably fastening the first portion and the second portion together. The first portion comprises a substantially non-absorbent surface and the second portion comprises a substantially absorbent surface which is preferably soft-textured.

The substantially non-absorbent surface of the first portion is highly impervious to diaper messes, thus enabling a user to wipe off a mess and save the time and resources that would be required to replace, change, or wash an absorbable material after each use. In a preferred embodiment, the substantially absorbent surface of the second portion comprises a soft texture so that the baby is comfortable with its upper portion resting on the soft surface. Because the baby changing pad cover comprises means for detachably fastening the first and second portions together, the two portions are detachable in the event that a user desires to wash the absorbent portion.

It is to be understood that both the foregoing general description and the following detailed description are exemplary, but not restrictive, of the invention.

BRIEF DESCRIPTION OF THE DRAWINGS

The invention is best understood from the following detailed description when read in connection with the accompanying drawings, in which similar elements among the embodiments have reference numerals ending with the same digits. It is emphasized that, according to common practice, the various features of the drawings are not to scale. Included in the drawings are the following figures.

DETAILED DESCRIPTION OF THE INVENTION

The present invention is directed to a baby changing pad cover that is positionable over a changing pad. As used throughout, the term "changing pad" includes any pad, mat, or mattress upon which a baby may be placed in order for a person to change a baby's diaper. Although the changing pad and changing pad cover are principally illustrated in the figures as having a substantially rectangular shape, the changing pad and changing pad cover are also contemplated as having a variety of alternative shapes, including, for example, an oval or square shape. In a preferred embodiment, the changing pad cover is positionable over a conventional pad intended for diaper-changing, as illustrated in the embodiment shown in FIG. 2.

Figure 1:
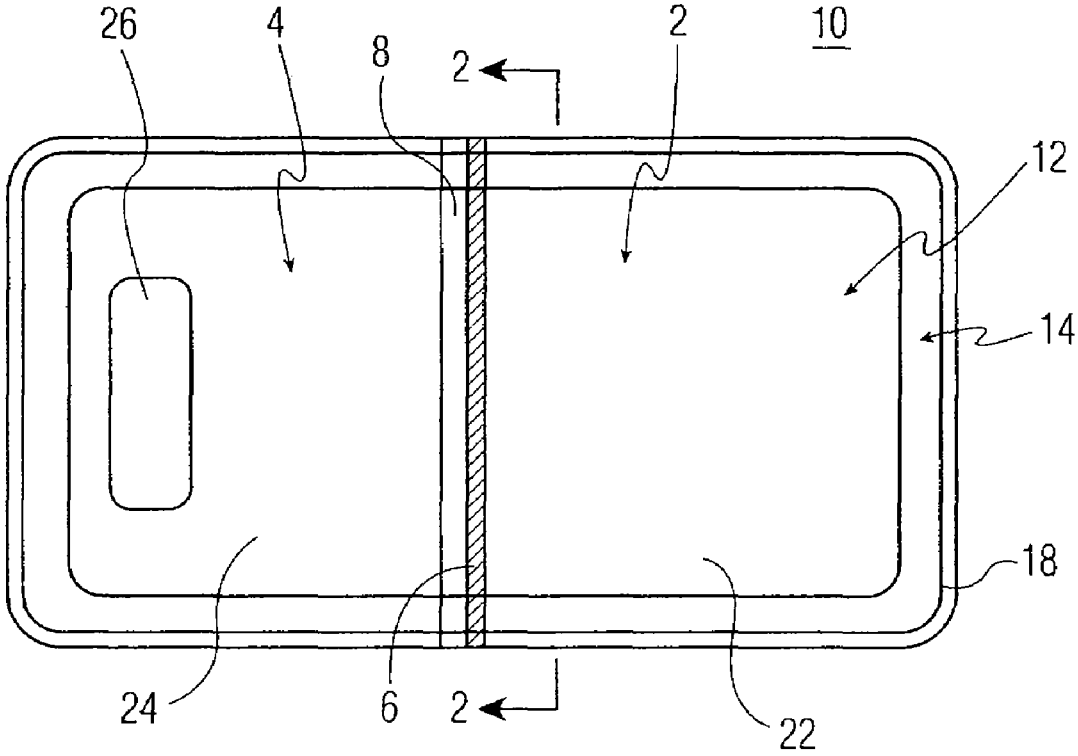
FIG. 1 illustrates a top view of an embodiment of the present invention.

Referring now to FIG. 1, the baby changing pad cover 10 comprises a first portion 2, a second portion 4, and fastening means 6 for detachably fastening the first portion 2 and the second portion 4 together. The first portion 2 comprises a substantially non-absorbent surface 22 and the second portion 4 comprises a substantially absorbent surface 24 which is preferably soft-textured. The substantially non-absorbent surface 22 of the first portion 2 is configured to receive the lower portion of a baby and the substantially absorbent surface 24 of the second portion 4 is configured to receive the upper portion of a baby. As used herein, the upper portion of a baby comprises the baby's head and a portion of its upper body; and the lower portion of a baby comprises a portion of its lower body, preferably its lower back and below its waist.

The first portion 2 of the changing pad cover 10 comprises a substantially non-absorbent surface 22 so that diaper messes are substantially prevented from being absorbed. Unlike prior art systems where the lower portion of a baby is placed on an absorbent material into which a diaper mess is absorbed, the substantially non-absorbent surface 22 of the present invention is highly impervious to diaper messes. Thus, a user avoids the task of removing soiled absorbent material after each mess and washing it with soap and water in, for example, a washing machine, sink, or laundry tub. Instead, a user is able to wipe a diaper mess off of the substantially non-absorbent surface 22 with, for example, a cloth, paper towel, or disinfecting wipe, and save the time and resources that would be required to replace, change, or wash the soiled cover after each mess. The saved time and resources become especially significant if the changing pad cover 10 is used several times per day, or if it is used for more than one baby, such as in a day care center.

In one embodiment, the substantially non-absorbent surface 22 of the baby changing pad cover 10 comprises a plastic or vinyl material and the substantially absorbent 24 surface comprises a cloth or fabric material. Preferably, the changing pad cover 10 is malleable, thus enabling a user to fold it up if desired. The substantially absorbent surface 24 of the second portion 4 is preferably soft-textured to provide added comfort for a baby. The substantially absorbent surface 24 preferably has a soft texture so that the baby is comfortable with its upper portion positioned on the soft surface. In an alternative embodiment, the baby changing pad cover 10 further comprises a head support 26 for a baby. A head support 26 is intended to provide added comfort for a baby while the baby is resting on the changing pad cover 10. The surface of the head support 26 preferably comprises an absorbent material, and is most preferably soft-textured.

The baby changing pad cover 10 comprises fastening means 6 for detachably fastening the first portion 2 and second portion 4 together. The two portions are detachable in the event that a user desires to wash the substantially absorbent surface 24 in, for example, a washing machine, sink, or laundry tub. Because the substantially absorbent surface 24 is not configured to receive the lower portion of a baby, diaper messes are not likely to occur on the substantially absorbent surface 24. Therefore, the substantially absorbent surface 24 is not intended to be detached for washing after each diaper mess, but for occasional washing if the user so desires.

Examples of fastening means 6 for detachably fastening the first portion 2 and the second portion 4 together include, for example, a zipper, hook-and-loop fasteners, snaps, buttons, Velcro®, or a combination thereof.

In an exemplary embodiment, the changing pad cover 10 further comprises a protective portion 8 which covers the top of the fastening means 6. Although the fastening means 6 are generally not visible from a top view when covered by the protective portion 8, FIG. 1 shows the fastening means 6 and the top of the protective portion 8 for sake of clarity. The protective portion 8 inhibits a baby's skin from coming into contact with the fastening means 6 while the baby is resting on the changing pad cover 10. The protective means 8 may be lifted back to reveal the fastening means 6 in the event, for example, that a user wishes to access the fastening means 6 in order to detach the first portion 2 and second portion 4. The protective portion 8 preferably comprises soft-textured material that is similar or identical to the substantially absorbent surface 24 material.

Figure 2:
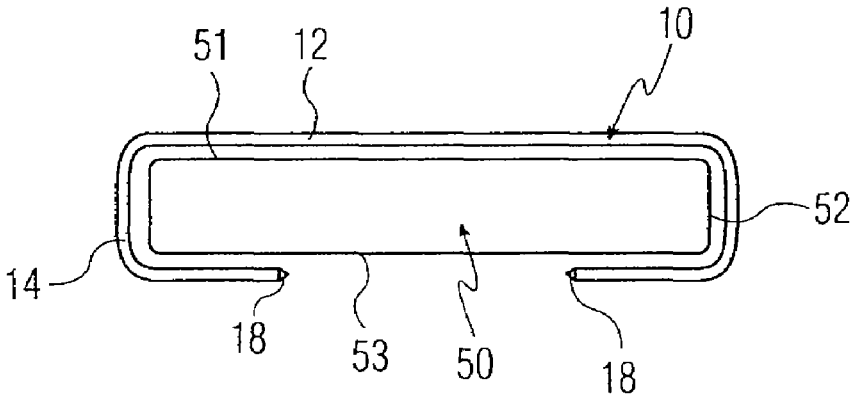
FIG. 2 illustrates a cross-sectional view, along the line 2-2, of the embodiment of the present invention shown in FIG. 1 positioned over a changing pad.

Referring now to FIG. 2, the baby changing pad cover 10 comprises a top portion 12 and a remaining portion 14, such that when the changing pad cover 10 is positioned over a changing pad 50, the top portion 12 covers the top surface 51 of the changing pad 50 and the remaining portion 14 covers the side surfaces 52 and a portion of the bottom surface 53 of the changing pad 50. It is contemplated that the changing pad cover 10 is in substantial contact with the changing pad 50 when positioned over the changing pad 50. Therefore, in FIG. 2, it should be appreciated that the space between the changing pad cover 10 and the changing pad 50 is shown for sake of clarity. In a preferred embodiment, the baby changing pad cover 10 further comprises flexible means 18 for substantially conforming the changing pad cover 10 over the top surface 51, side surfaces 52, and a portion of the bottom surface 53 of a changing pad 50. The flexible means 18 preferably comprise elastic material, with the elastic material most preferably disposed along the periphery of the changing pad cover 10. The flexible means 18 are intended to cause the changing pad cover 10 to substantially conform to the shape of the changing pad 50 and to provide a snug fit. In an exemplary embodiment, the changing pad cover 10 fits snugly over the top surface 51, side surfaces 52, and a portion of the bottom surface 53 of a conventional changing pad.

Although the present invention is illustrated and described herein with reference to specific embodiments, the invention is not intended to be limited to the details shown. Rather, various modifications may be made in the details within the scope and range of equivalents of the claims and without departing from the invention.

What is claimed is:

1. A baby changing pad cover for use with a changing pad comprising:

a first portion configured to receive the lower portion of a baby, the first portion absent an absorbent component and comprising a substantially non-absorbent surface;

a second portion configured to receive the upper portion of the baby, the second portion absent a non-absorbent component and comprising a substantially absorbent surface; and means for detachably fastening the first portion and the second portion together, wherein the baby changing pad cover is positionable over the changing pad.

2. The baby changing pad cover according to claim 1, wherein the means for detachably fastening the first portion and the second portion together comprise at least one of a zipper, hook-and-loop fasteners, snaps, buttons, or a combination thereof.

3. The baby changing pad cover according to claim 1 further comprising a head support detachably coupled to the substantially absorbent surface.

4. The baby changing pad cover according to claim 1, wherein the substantially non-absorbent surface comprises a plastic or vinyl material and the substantially absorbent surface comprises a cloth or fabric material.

5. The baby changing pad cover according to claim 1 further comprising a protective portion, wherein the protective portion covers the means for detachably fastening the first portion and the second portion together.

6. The baby changing pad cover according to claim 1, wherein the substantially non-absorbent surface is substantially impervious to a diaper mess.

7. The baby changing pad cover according to claim 1, wherein the baby changing pad cover comprises a top portion positionable over a top surface of the changing pad and a remaining portion positionable over side surfaces and a portion of a bottom surface of the changing pad.

8. The baby changing pad cover according to claim 7, wherein the top portion is in the shape of a modified rectangle having curved corners.

9. The baby changing pad cover according to claim 1 further comprising flexible means for substantially conforming the baby changing pad cover over the changing pad.

10. The baby changing pad cover according to claim 9, wherein the flexible means comprise elastic material.

11. The baby changing pad cover according to claim 10, wherein the elastic material is disposed along the periphery of the baby changing pad cover.

12. The baby changing pad cover according to claim 1, wherein the means for detachably fastening the first portion and the second portion together are located in a central portion of the baby changing pad cover and are substantially orthogonal to the longitudinal axis of the baby changing pad cover.

13. The baby changing pad cover according to claim 1, wherein the first portion is positioned over a first portion of the changing pad and the second portion is positioned over a second portion of the changing pad.

* * * * *